US007353574B2

(12) United States Patent
Wu et al.

(10) Patent No.: US 7,353,574 B2
(45) Date of Patent: Apr. 8, 2008

(54) LUGGAGE STRAP CONNECTOR

(75) Inventors: Peter Chang-Lin Wu, Piscataway, NJ (US); Paul Victor Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 11/509,169

(22) Filed: Aug. 24, 2006

(65) Prior Publication Data

US 2008/0047114 A1 Feb. 28, 2008

(51) Int. Cl.
*A41F 1/00* (2006.01)

(52) U.S. Cl. ..... 24/669; 24/700

(58) Field of Classification Search ..... 24/652, 24/656, 657, 662, 663, 664, 679, 680, 681, 24/700, 701, 669
See application file for complete search history.

(56) References Cited

U.S. PATENT DOCUMENTS

| | | | | |
|---|---|---|---|---|
| 607,742 A | | 7/1898 | Gorton | |
| 696,912 A | | 4/1902 | Ross | |
| 781,430 A | | 1/1905 | Kellogg | |
| 805,559 A | | 11/1905 | Kleinert | |
| 867,255 A | | 10/1907 | Dietz | |
| 910,879 A | | 1/1909 | Taylor | |
| 920,186 A | | 5/1909 | Schloss | |
| 1,172,703 A | * | 2/1916 | Grooms | 24/669 |
| 1,236,079 A | * | 8/1917 | Hentschel | 24/669 |
| 2,239,004 A | * | 4/1941 | Jung | 24/669 |
| 2,986,791 A | * | 6/1961 | Strehlein | 24/669 |
| 3,313,008 A | * | 4/1967 | Littell et al. | 24/669 |
| 5,106,223 A | * | 4/1992 | Kraus | 403/11 |
| 5,927,580 A | | 7/1999 | Ward-Llewellyn | |

* cited by examiner

*Primary Examiner*—Robert J. Sandy
(74) *Attorney, Agent, or Firm*—Charles E. Baxley

(57) ABSTRACT

A luggage carrying strap connector has a stud with a shank that protrudes perpendicularly from the carrying strap and ends in a head that is larger than the shank. The head and a shank protrude through an aperture in a clasp secured to the end of the strap. A bight in the end of the clasp bears the luggage weight, thus enabling the clasp to take advantage of the luggage weight to increase the strength of the engagement between the stud and the clasp. Resilient members have portions that protrude into the bight to form a gap that is smaller then the corresponding width of the shank to prevent connector disengagement during normal handling but also to avoid impeding coupling and uncoupling the stud and the clasp.

2 Claims, 3 Drawing Sheets

LUGGAGE STRAP CONNECTOR

CROSS-REFERENCES TO RELATED APPLICATIONS

None

STATEMENT REGARDING FEDERALLY SPONSORED RESEARCH OR DEVELOPMENT

None

JOINT RESEARCH AGREEMENT PARTNER

None

REFERENCE TO "SEQUENCE LISTING"

None

BACKGROUND OF THE INVENTION

This invention relates to quick connection and release buckles and more particularly to a stud and clasp combination for selectively disconnecting and attaching carrying straps to luggage, and the like.

BRIEF DESCRIPTION OF THE PRIOR ART

Stud and clasp combinations for connecting items of clothing have been in use for many years. Illustratively, to support a stocking from an undergarment it had been customary to attach a clasp and an associated stud to the undergarment. The stud, having an enlarged head, took a purchase on a portion of the stocking and the combined stocking portion and head were pressed through an opening in the clasp. So engaged, the part of the stud that was below the head and a further portion of the stocking associated with that lower part of the stud were jammed into a narrow bight formed in the clasp opening. The bight often had a lining that not only enjoyed a high coefficient of friction to increase the force holding the stud in the bight, but that also avoided abrading, tearing, or destroying the portion of the stocking fabric that was grasped between the stud and the adjoining sides of the bight. These garment connectors, however, were limited in concept and application to supporting an item of clothing that was frictionally gripped between the stud and the clasp.

With respect to detachable traveling straps for items of luggage, however, the emphasis had been directed to complicated snap fasteners and other spring loaded devices for temporarily coupling a strap to an item of luggage. Such devices were expensive to manufacture and difficult to assemble. In use, moreover, these devices led to broken fingernails, broken and deformed springs, and fasteners that failed, causing the supported luggage to drop to the floor, quite frequently at a most inconvenient time.

Accordingly, there is a need for a sturdy, inexpensive and reliable device for connecting and disconnecting items of luggage to carrying straps, handles and the like.

BRIEF SUMMARY OF THE INVENTION

These and other disadvantages of the prior art are largely overcome through the practice of the invention.

For example, in accordance with the invention, a stud is provided with a shank and an enlarged head at an end of the shank. The head has a broad flattened base at the opposite end of the shank, the base joining the stud to a reinforced portion of a carrying strap in a manner that enables the shank to protrude perpendicularly from the reinforced strap portion. A clasp having an aperture that is larger than the width of a corresponding portion of the stud head is attached to an end of the reinforced strap portion. A bight, moreover, is formed in a side of the clasp aperture that corresponds to the anticipated place of luggage load application. Also, the bight is lined with a resilient material that provides a high coefficient of friction with the material from which the stud is formed. The material lining the bight is resilient and the lined entrance to the bight forms a gap that is slightly narrower than the corresponding width of the stud's shank.

Consequently, to couple the stud to the clasp, it is only necessary to press the head of the stud through the clasp aperture. The shank of the stud is then pressed past the resilient and narrow gap at the entrance to the clasp's bight.

In accordance with a salient feature of the invention, because of the relative position of the aperture's bight with respect to the attached item of luggage, the heavier the luggage, the greater is the force that presses the stud into the end of the bight. Thus, through the novel orientation of the stud, the aperture's bight and the applied loading that characterizes this invention, the loading is manipulated to strengthen the coupling between the stud and the clasp.

To disengage the carrying strap from the piece of luggage, it is only necessary to press the stud's shank through the gap, out of the bight and into the clasp's aperture. The stud and the enlarged head then are withdrawn from the aperture. In this manner, the practice of the invention overcomes the higher manufacturing costs of prior art devices and enables the traveler to free the strap from the item of luggage without risk of broken fingernails, broken or deformed springs, accidentally dropped luggage, and the like.

DETAILED DESCRIPTION OF A PREFERRED EMBODIMENT OF THE INVENTION

Figure 1:
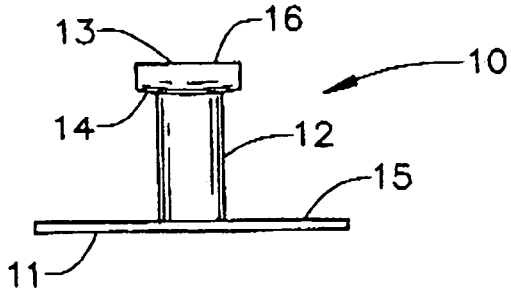
FIG. 1 is a front elevation of a stud for use in connection with the invention.

For a more detailed understanding of the advantages and features of the invention, attention is invited to FIG. 1 which shows a stud 10 of a durometer 82, zinc alloy or of other suitable metal, hard plastic or the like. The stud 10 has a flat base 11 and a shank 12 that is generally perpendicular to the base 11. At the end of the shank 12 a head 13, substantially wider than the shank 12 and having an arcuate undersurface 14 is spaced from opposing surface 15 on the flat base 11. As illustrated in FIG. 1, the curvature of the arcuate undersurface 14 is oriented toward the opposing surface 15 of the flat base 11.

Figure 4:
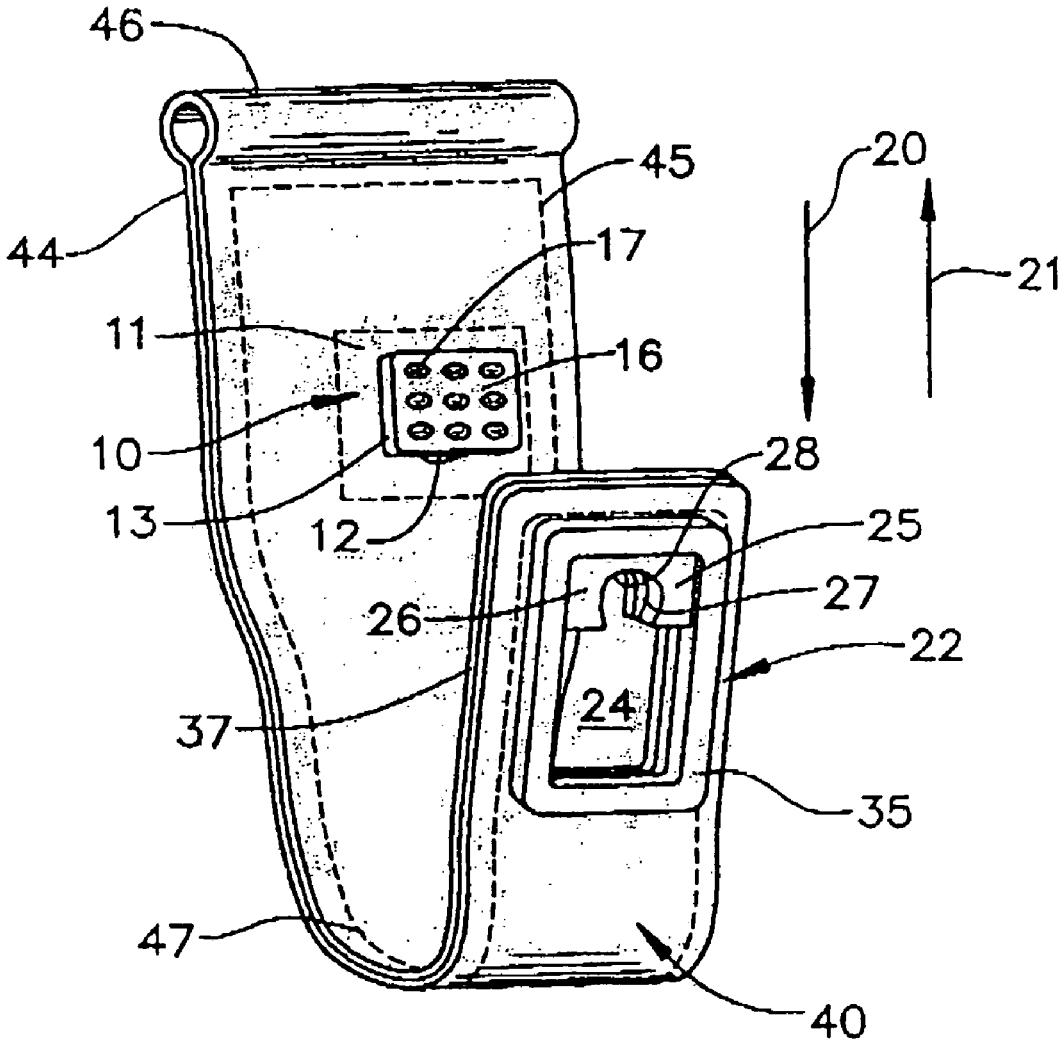
FIG. 4 is a perspective view of the stud and clasp shown in FIGS. 1 through 3 attached to a reinforced portion of a luggage carrying strap.

An exposed surface 16 of the head 13 is sufficiently large to accommodate the end of an index finger or a thumb (not shown in the drawing), the exposed surface 16 as shown in FIG. 4 being roughened or otherwise treated 17 to enable the index finger or a thumb to apply force to the stud 10 selectively in the directions of the arrows 20, 21 without sliding or slipping off the exposed surface 16, of the head 13.

Figure 2:
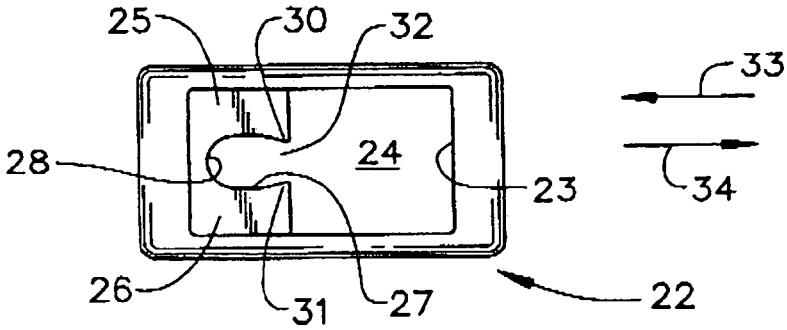
FIG. 2 is a plan view of a clasp for use in connection with the stud shown in FIG. 1.

Turning now to FIG. 2 a generally rectangular clasp 22 is also formed of a durometer 82, zinc alloy or other suitable metal, hard plastic or the like. As shown, the clasp 22 has an edge 23 that defines a generally rectangular aperture 24. A pair of opposing resilient members 25, 26 are mounted at the inner edge 23 of the clasp 22 in order to form a bight 27 having a rounded end 28 that is somewhat greater than that the circumference of the shank 12. In accordance with another feature of the invention, the bight 27 has slight protrusions 30, 31 that form a gap 32, the width of the gap 32 being slightly less than the corresponding dimension of the shank 12 (FIG. 1). The width established by the parallel portions of the resilient members 25, 26 forming sides of the bight 27, however are at least as wide as the thickness of the corresponding portion of the shank 12.

The elasticity of the protrusions 30, 31 that form the gap 32 is adequate to hold the shank 12 in the bight 27 through the normal forces encountered by luggage in transit. The resiliency of the protrusions 30, 31, however, is sufficiently flexible to permit the shank 12 to be pressed with only digital force in the direction of arrow 33 past the gap 32 and into the portion of the bight 27 that is not occupied by the respective protrusions 30, 31 on the resilient members 25, 26. Similarly, the protrusions 30, 31 also enable the shank 12 to be digitally pressed in the direction of arrow 34 from a position in the rounded end 28 of the bight 27 into the aperture 24, as described subsequently.

Figure 3:
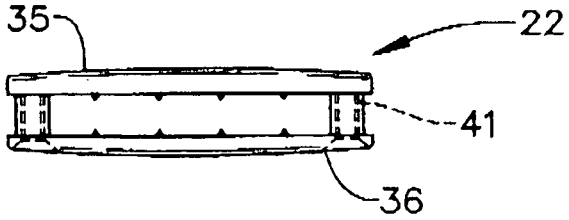
FIG. 3 is a front elevation of the clasp shown in FIG. 2.

With respect to FIG. 3, it should be noted that the clasp 22 is divided into an exposed portion 35 and a generally parallel inner portion 36 that is spaced from the opposing surface of the exposed portion by a distance approximately equal to thickness 37 (FIG. 4) of a reinforced carrying strap 40. Preferably, the strap 40 is of 95 durometer thermoplastic polyurethane, although other appropriate materials (e.g. leather) also can be used in connection with the invention. In this respect, the exposed portion 35 (FIG. 3) and the inner portion 36 are joined to the strap 40 by means of screws, rivets, fasteners 41 or the like that are shown schematically in FIG. 3.

Figure 7:
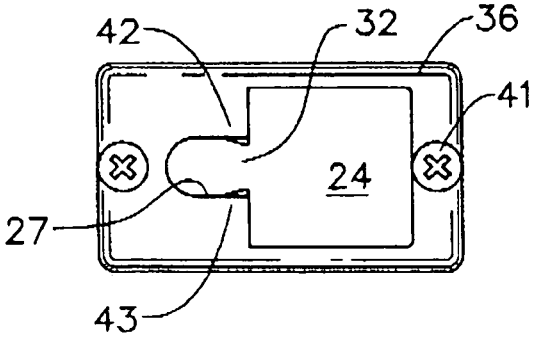
FIG. 7 is a bottom elevation of the clasp shown in FIG. 2.

Further in connection with this feature of the invention and as shown in FIG. 7, the inner portion 36 of the clasp 22 also forms the bight 27 in a portion of the aperture 24. Note in this respect that the width of the parallel sides of the bight 27 as provided by the inner portion 36 is uniform throughout the length of the bight 27 and are spaced from each other through a distance that is greater than the gap 32. The gap 32 that characterizes the resilient members 25, 26 (FIG. 2) is formed only the by the protrusions 30, 31 in the resilient members 25, 26. Thus, the inner portion 36 (FIG. 7) of the clasp 22 has two opposing, rigid sections 42, 43 that reinforce the resilient members 25, 26 (FIG. 2) and support the luggage load (not shown in the drawing) during strap carriage.

Turning once more to FIG. 4, it can be seen that the carrying strap 40 is reinforced through a double thickness 44 of fabric, the double thickness 44 being joined together through stitching 45 and an interleaved layer of suitable glue (not shown in the drawing). The strap 40 also has a hole formed in it (not shown) that accommodates the clasp 22 and enables the clasp 22 to be secured to the strap 40 by means of the fasteners 41 (FIG. 7). To secure the stud 10 (FIG. 4) in the strap 40, the flat base 11 is sandwiched between the two thicknesses 37 that form the double thickness 44 of the carrying strap 40. In this manner, the head 13 and its associated shank 12 protrude above the surface of the carrying strap 40. Also as shown in FIG. 4, a loop 46 is formed in an end of the carrying strap 40 to accommodate a shackle or the like (not shown) that joins the carrying strap 40 to the balance of the carrying strap structure (also not shown).

Figure 5:
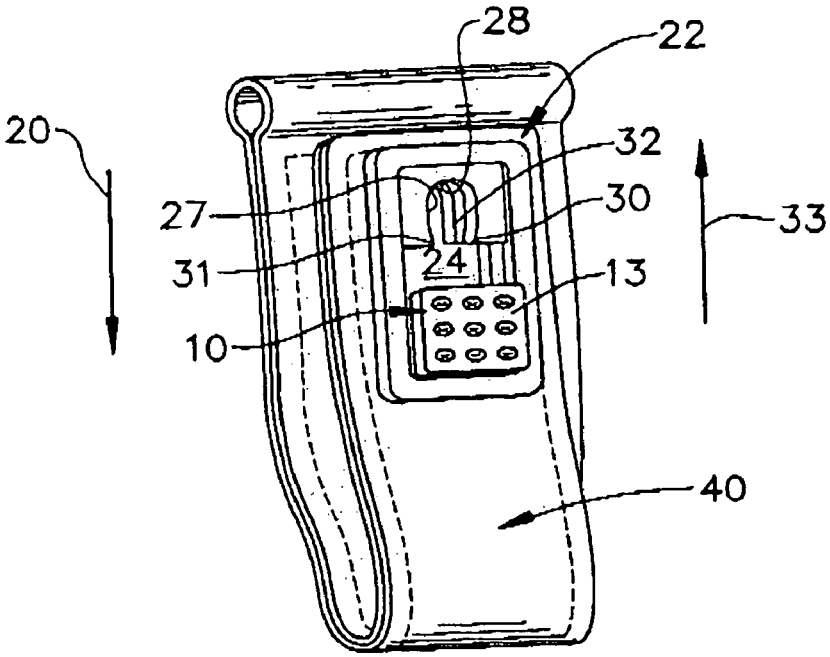
FIG. 5 is a perspective view of the carrying strap and connector combination.

In operation, the carrying strap 40 is looped at its general midpoint 47 between the stud 10 and the clasp 22 through a shackle on an item of luggage (not shown). As best illustrated in FIG. 5, the head 13 of the stud 10 is pressed through the aperture 24 in the clasp 22. To lock the strap 40 closed, the head 13 is pressed digitally in the direction of the arrow 33 to force the shank 12 (not shown in FIG. 5) past the gap 32 formed by the resilient protrusions 30, 31 and to seat the shank 12 of the stud 10 securely in the rounded end 28 of the bight 27. When complete, the strap 40, the stud 10 and clasp 22 should appear as illustrated in FIG. 6.

Figure 6:
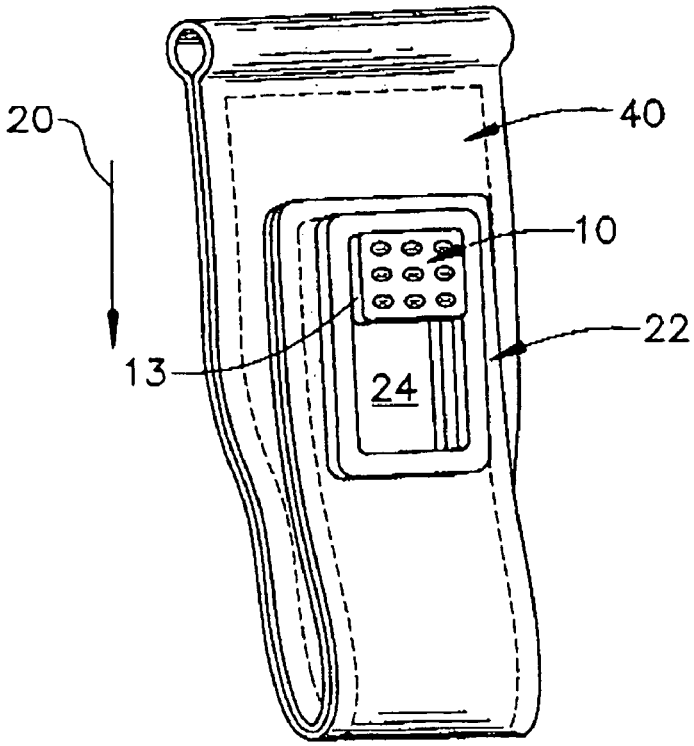
FIG. 6 is a perspective view of the carrying strap and connector combination in a coupled status.

In accordance with a specific feature of the invention, it should be noted that the luggage load is borne in the direction of the arrow 20 (FIG. 6). The structural load consequently is supported on the base 11 (FIG. 4), the shank 12 and the head 13 of the stud 10 as these elements bear, respectively, against the strap 40, the rounded end 28 of the bight 27 and the rigid sections 42, 43 (FIG. 7) of the inner portion 36 of the clasp 22.

During transit, and as specifically illustrated in FIG. 5, the ordinarily anticipated motions and forces applied to the luggage and the associated strap 40 in the direction of the arrow 20 that release or just reduce the load applied to the strap 40 do not disengage the stud 10 from its position seated within the bight 27 because the resilient protrusions 30, 31 are sufficiently stiff to prevent the shank (not shown in FIG. 5) from slipping through the gap 32 and into the aperture 24.

To release the strap 40, and as shown in FIG. 6, a thumb or index finger is pressed against the head 13 of the stud 10 to push the stud 10 in the direction of the arrow 20. When the stud 10 (FIG. 5) is reseated in the aperture 24, the clasp 22 is lifted out of the plane of the drawing as shown in FIG. 4 and toward the observer, thus restoring the strap 40 to the disengaged condition as illustrated.

Consequently, the invention provides a sturdy, reliable, relatively inexpensive and safe connector for luggage carrying straps, and the like.

What is claimed is:

1. A connector for sustaining the weight applied to a luggage carrying strap comprising, a stud having a shank for sustaining the luggage through the carrying strap and a head on said shank and larger than said shank and generally perpendicular to said shank, a clasp having an exposed portion and an inner portion spaced from each other to accommodate the carrying strap at least one of said portions forming a bight having an end greater than the width of said shank to accommodate at least a portion of said shank therewithin, a resilient member in said clasp having a resilient member bight generally matching said clasp portion bight and having an end thereto, said clasp portion and said resilient member bights being oriented to sustain the weight applied by the carrying strap through said shank and protrusions formed on said resilient member to form a gap therebetween in said resilient member bight, said gap being narrower than said shank to impede passage of said shank through the gap.

2. A connector according to claim 1 further comprising an exposed surface on said head, said exposed surface being treated to increase friction forces applied thereto.

* * * * *